US007096608B2

(12) United States Patent
Kuroiwa et al.

(10) Patent No.: US 7,096,608 B2
(45) Date of Patent: Aug. 29, 2006

(54) OVERLOAD PREVENTION DEVICE FOR A SNOW REMOVING MACHINE

(75) Inventors: Kenji Kuroiwa, Wako (JP); Kenji Kamata, Wako (JP); Yasutomo Abe, Wako (JP); Tsutomu Mizoroke, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/655,840

(22) Filed: Sep. 5, 2003

(65) Prior Publication Data

US 2004/0049953 A1 Mar. 18, 2004

(30) Foreign Application Priority Data

Sep. 13, 2002 (JP) ..... 2002-268753
Mar. 13, 2003 (JP) ..... 2003-067596

(51) Int. Cl.
*E01F 5/09* (2006.01)

(52) U.S. Cl. ..... 37/245; 37/244; 477/178

(58) Field of Classification Search ..... 37/244, 37/245, 249, 253; 477/178, 177; 192/56.1
See application file for complete search history.

(56) References Cited

U.S. PATENT DOCUMENTS 3,313,049 A 4/1967 Blozis
5,000,302 A * 3/1991 Takeshita ..... 192/17 R
5,101,911 A * 4/1992 Lee et al. ..... 172/48
5,156,244 A * 10/1992 Pyles et al. ..... 477/178
5,398,431 A * 3/1995 Beihoffer et al. ..... 37/249
5,419,745 A * 5/1995 Moolenaar et al. ..... 477/20
5,545,109 A * 8/1996 Hayakawa ..... 477/178
5,802,745 A * 9/1998 Haseotes et al. ..... 37/234
6,070,679 A * 6/2000 Berg et al. ..... 180/19.2
6,212,799 B1 * 4/2001 Gingerich et al. ..... 37/246
6,443,872 B1 * 9/2002 Nakashima ..... 477/174
6,523,283 B1 * 2/2003 Sueshige et al. ..... 37/245
2001/0008055 A1 7/2001 Sueshige et al.
2002/0014132 A1 * 2/2002 Sueshige et al. ..... 74/425

FOREIGN PATENT DOCUMENTS

EP 1 186 716 A2 3/2002
JP 51034111 8/1976

* cited by examiner

*Primary Examiner*—Thomas A Beach
(74) *Attorney, Agent, or Firm*—Adams & Wilks

(57) ABSTRACT

An overload prevention device has a first rotational member for driving engagement with an input shaft of an auger transmission of a snow removing machine, a second rotational member engaging the first rotational member for rotation therewith over a predetermined torque range and for rotation relative thereto when a predetermined torque is exceeded, and a movable member mounted adjacent to the first rotational member for undergoing movement to restrict a rotating angle of the second rotational member. A detector outputs a detection signal each time the detector detects movement of the movable member in a direction away from the first rotational member when protuberances of the movable member engage protrusions of the first rotational member responsive to relative rotation between the first and second rotational members. A control unit stops operation of the engine when the detector outputs the detection signal a preselected number of times within a preselected time period.

14 Claims, 16 Drawing Sheets

OVERLOAD PREVENTION DEVICE FOR A SNOW REMOVING MACHINE

FIELD OF THE INVENTION

The present invention relates to an overload prevention device for a snow-removing machine for preventing an excessive load acting on a power train from an engine to an auger of the snow-removing machine.

BACKGROUND OF THE INVENTION

Snow-removers which clear snow by transmitting power from an engine to an auger and rotating the auger have been known (e.g., JP-UM-B-51-34111).

Such a snow-remover is comprised of a drive pulley attached to an output shaft of an engine, a belt trained around the drive pulley and a driven pulley, a rotating transmission shaft extending forward from the driven pulley, a rotating auger shaft connected to the front end of the rotating transmission shaft by way of a gear case, and an auger attached to the rotating auger shaft.

For example, during snow-removing work, it sometimes happens that the auger bites into a lump of ice or a stone or the like and the rotation of the auger is stopped, causing an excessive load to act on the power train from the engine to the auger. It is desirable for this kind of excessive load to be eliminated.

However, when an overload is detected, for example if the engine is stopped by instantaneous overloads occurring at times such as when the auger hits a curbstone or the like, or if the engine is stopped by noise from a detector for detecting overloads, optimal overload prevention cannot be achieved. That is, it is desirable for instantaneous overloading occurring when the auger hits a curbstone or the like and erroneous overloading caused by detector noise to be distinguished from continuous overloading caused by the auger biting into snow or debris. That is, in a snow-remover, an overload prevention device which can surely determine that overloading has occurred, and deal with this overloading, is desirable.

SUMMARY OF THE INVENTION

According to the present invention, there is provided an overload prevention device for a snow-remover for, in the transmission of power from an engine through an auger transmission to an auger shaft and an auger in turn, preventing an excessive load from acting on the power train from the engine to the auger, the overload prevention device comprising: a worm wheel for meshing with a worm provided on an input shaft of the auger transmission; a cylindrical member which is fitted in the worm wheel and consequently rotates integrally therewith over a predetermined torque range and rotates relative thereto when a predetermined torque is exceeded, and which is attached integrally to the auger shaft; a disk-shaped member which is limited in angle of turn with respect to the cylindrical member and is adjacent to the worm wheel and has plurality of disc protuberances facing a plurality of wheel protrusions provided on a side face of the worm wheel; a detector which detects movement of the disc away from the side face of the worm wheel when due to turning of the cylindrical member relative to the worm wheel the disc protuberances mount the wheel protrusions; and a control unit which stops the engine when the number of times a detection signal is generated by the detector reaches a predetermined number of times within a predetermined period.

By a control unit being provided which stops the engine when the number of times a detection signal is generated by the detector reaches a predetermined number of times, instantaneous overloading occurring when the auger hits a curbstone or the like is distinguished from continuous overloading caused by the auger biting into snow or debris. As a result, unnecessary stopping of the engine can be avoided, and the efficiency of snow-removing work can be improved.

Preferably, each of the wheel protrusions has a flat part at its top. In this case, when the disc has mounted the wheel side part, the detector detects for a predetermined time that the disc has moved in the direction of the side face of the worm wheel. As a result, detector noise can be prevented from being erroneously recognized as overload, and stable control of the overload prevention device can be carried out.

BRIEF DESCRIPTION OF THE DRAWINGS

A preferred embodiment of the invention will now be described in detail, by way of example only, with reference to the accompanying drawings, in which.

DETAILED DESCRIPTION OF THE PREFERRED EMBODIMENT

Figure 1:
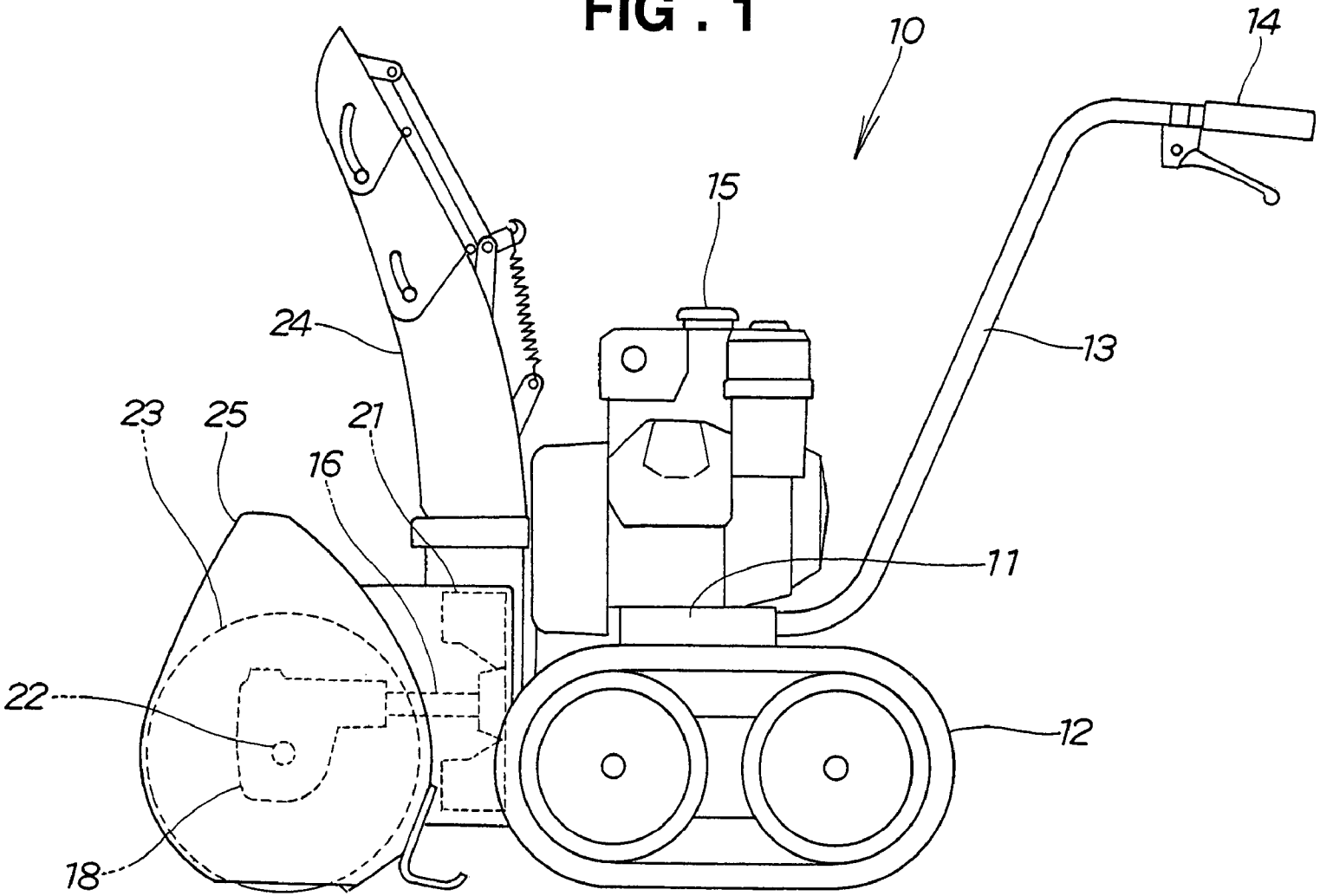
FIG. 1 is a side view of a snow-remover equipped with an overload prevention device according to the invention.

A snow-remover 10 shown in FIG. 1 has a machine frame 11, left and right crawlers 12 (the right crawler is not shown), a handle 13, an engine 15, a drive shaft 16, an auger 23, and a shooter 24.

The handle 13 extends rearward and upward from the machine frame 11 and has at its end a grip 14.

The engine 15 is mounted on the top of the machine frame 11. A drive shaft 16 rotated by this engine 15 extends in front of the machine frame 11 and is connected to an auger transmission 18 incorporating an overload prevention device 60 (see FIG. 9 and FIG. 10). A blower 21 is attached to the drive shaft 16. The auger 23 is attached to an auger shaft 22 of the auger transmission 18. The reference number 25 denotes an auger housing.

The drive shaft 16 and the auger transmission 18 constitute a "power transmission device" for transmitting power from the engine 15 to the auger 23.

In this snow-remover 10, the operation of the engine 15 rotates the drive shaft 16, the blower 21 is rotated by the drive shaft 16, and the auger 23 is rotated by way of the auger transmission 18. Snow shifted by the auger 23 is scooped up and blown far away through the shooter 24 by the blower 21.

Figure 2:
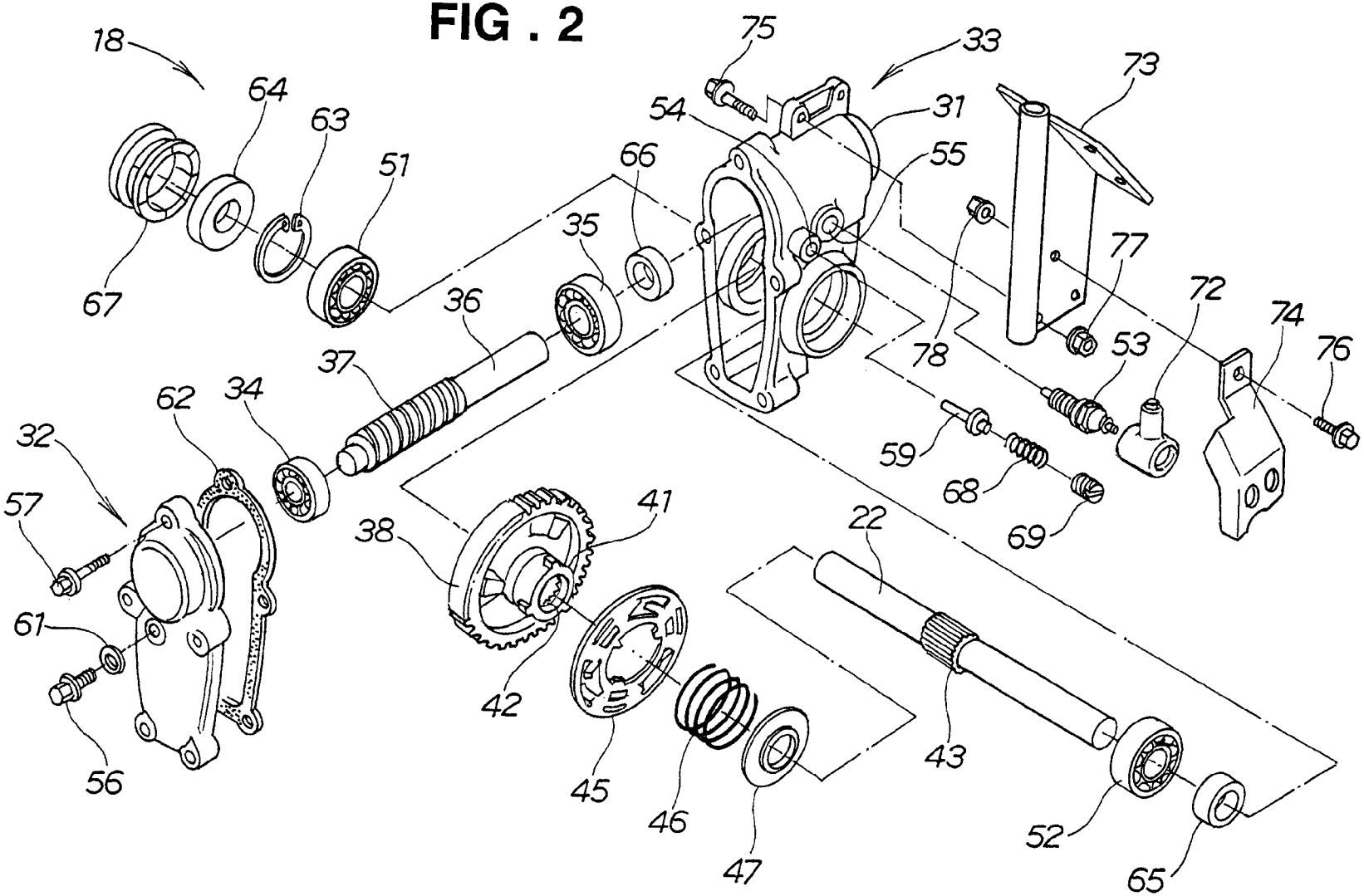
FIG. 2 is an exploded perspective view of an auger transmission incorporating an overload prevention device according to the invention.

Next, the auger transmission 18 of the power transmission device will be described, on the basis of FIG. 2.

The auger transmission 18 consists of a worm speed-reducer. This auger transmission 18 has a transmission case 33, an input shaft 36, a worm wheel 38 (first rotational member) an auger shaft 22, a washer detector switch 53, and a stopping member 59.

The transmission case 33 is made up of a case proper 31 and a case cover 32.

The input shaft 36 is mounted to the transmission case 33 on bearings 34, 35 and connected to the drive shaft 16 shown in FIG. 1. A worm 37 is formed on the input shaft 36.

The worm wheel 38 meshes with the worm 37. A cylindrical member (second rotational member) consisting of a cylindrical boss member 41 fits in the center of this worm wheel 38. A female spline 42 is formed in this boss member 41.

The auger shaft 22 has a male spline 43 which mates with the female spline 42. The auger shaft 22 is supported on bearings 51, 52 mounted to the case proper 31.

A slide washer 45 is is in the form of a generally disk-shaped member (movable member) adjacent to the worm wheel 38. This slide washer 45 is pressed against the worm wheel 38 by an elastic member 46. The elastic member 46 is pressed by a support plate 47 positioned on its outer side.

The washer detector switch 53 is a detector for detecting movement of the slide washer 45 away from one side face of the worm wheel 38.

The stopping member 59 temporarily stops movement of the slide washer 45, to restore the washer detector switch 53 to an initial state (an OFF state).

A receiving part 54 for receiving the stopping member 59 is formed on the case proper 31. A mounting part 55 for mounting the washer detector switch 53 to is formed on the case proper 31. An oil hole for pouring oil into the transmission case 33 through is plugged by a plugging bolt 56 fitted with a washer. Multiple bolts 57 (of which only one is shown in FIG. 2) hold together the case proper 31 and the case cover 32 with a gasket 62 therebetween.

In the figures, the reference number 63 denotes a circlip, and 64 through 66 are oil seals. The reference number 67 denotes a case cap. The stopping member 59 is urged into the receiving part 54 of the case proper 31 at all times by means of a biasing member, such as a compression spring 68, and a stopping member retainer 69. The washer detector switch 53 is protected by a protective switch cover 72. The reference number 73 denotes a bracket, and 74 is a switch side bracket. The reference numbers 75, 76 denote bolts, and 77, 78 are nuts.

The overload prevention device 60 shown in FIG. 9 and FIG. 10, as will be further discussed later, has as its main parts the worm wheel 38, the boss member 41, the slide washer 45, the elastic member 46, the support plate 47, the washer detector switch 53, the stopping member 59 and a control unit 105 (see FIG. 9 and FIG. 10).

Figure 3:
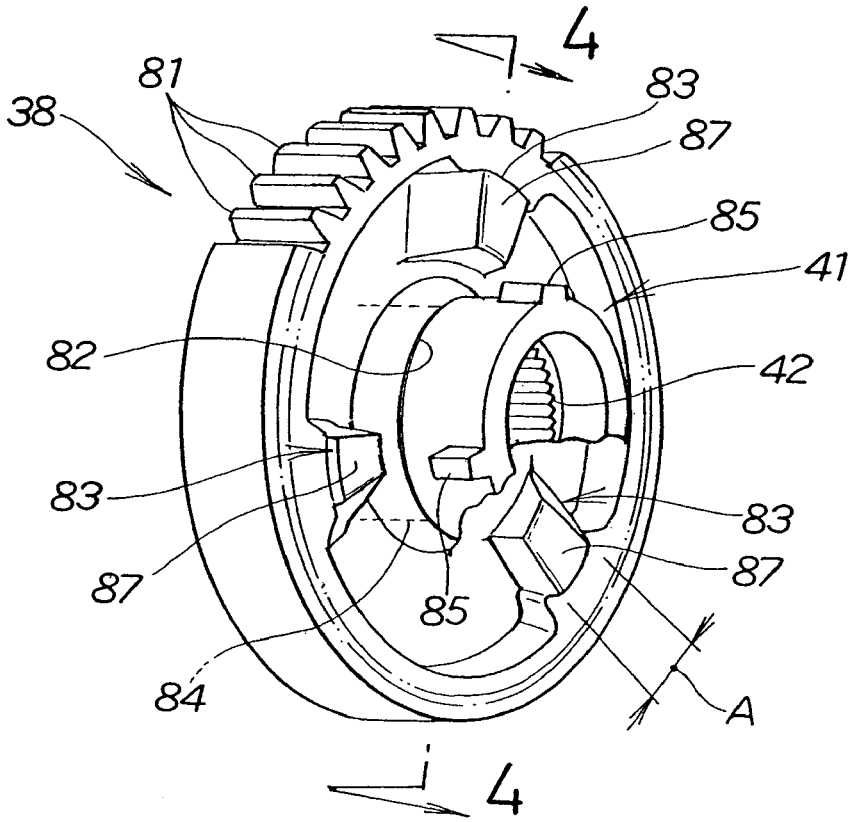
FIG. 3 is a perspective view of a worm wheel shown in FIG. 2.
Figure 4:
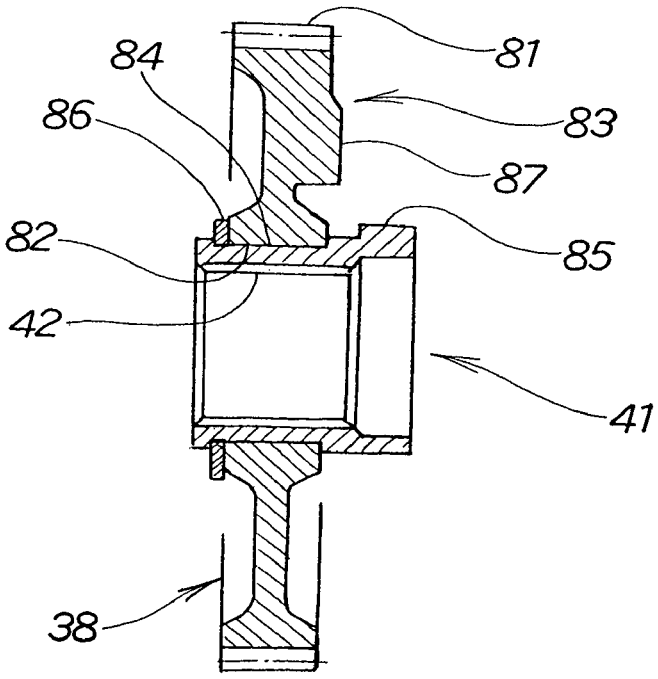
FIG. 4 is a sectional view taken along line 4—4 in FIG. 3.

The worm wheel 38 is shown in detail in FIG. 3 and FIG. 4.

The worm wheel 38 has multiple teeth 81 for messing with the worm 37 (see FIG. 2), a fitting hole 82 into which the boss member 41 fits, and a plurality of wheel protrusions 83 to which the slide washer 45 (see FIG. 2) is fitted. Each of the wheel protrusions 83 has a flat part 87 at its top. Stated otherwise, a top portion of each of the wheel protrusions 83 has a planar surface extending in a direction generally perpendicular to an axis of rotation of the worm wheel 38.

The circumferential part 84 of the boss member 41 fits in the fitting hole 82 of the worm wheel 38. By the male spline 43 of the auger shaft 22 (see FIG. 2) and the female spline 42 formed on the boss member 41 mating, the auger shaft 22 and the worm wheel 38 are connected. The boss member 41 has a plurality of external projections 85 with which the slide washer 45 shown in FIG. 2 engages.

The boss member 41 is retained in the worm wheel 38 by a retaining ring 86. The reference letter A denotes the width of the flat parts 87.

Figure 5:
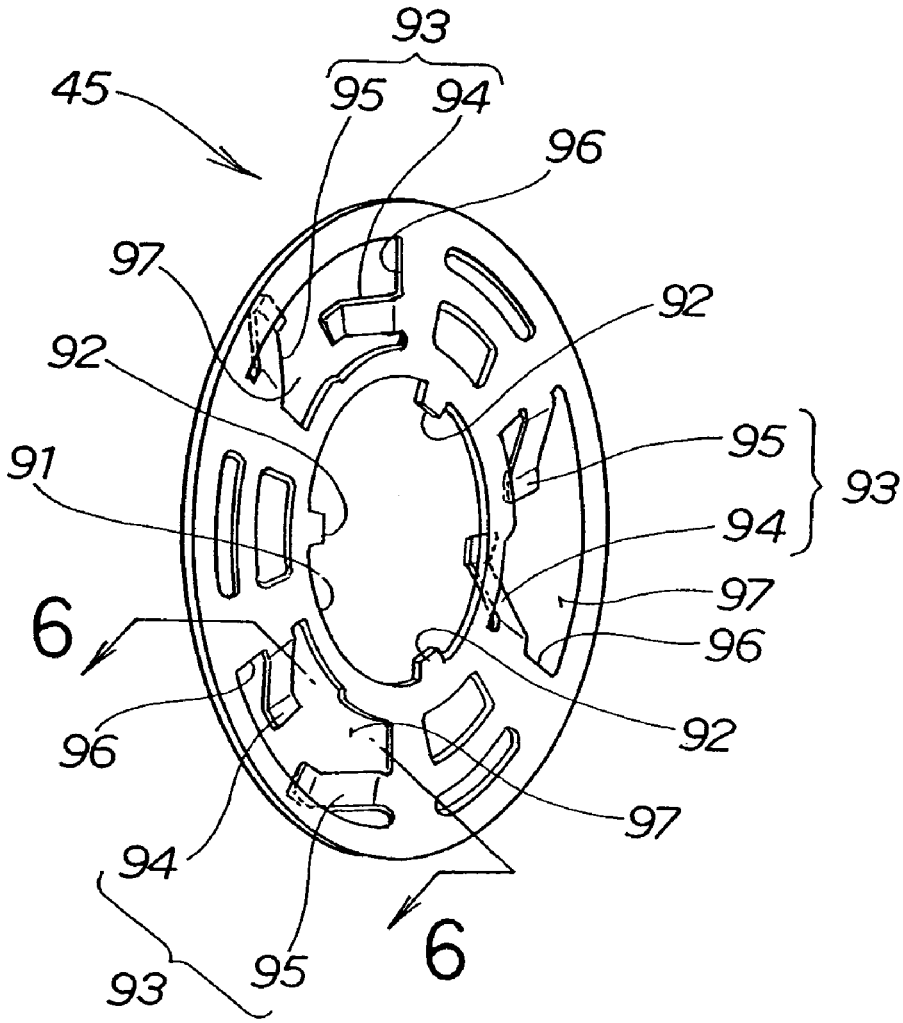
FIG. 5 is a perspective view of a slide washer shown in FIG. 2.

Next, the construction of the slide washer 45 will be described, with reference to FIG. 5 and FIG. 6.

The disk-shaped slide washer 45 has a fitting hole 91 into which the boss member 41 shown in FIG. 3 fits; a plurality of internal projections 92 for engaging with the plurality of external projections 85 formed on the outside of the boss member 41; generally disk-shaped protuberances 93 (hereinafter "disc protuberances") for engaging with the wheel protrusions 83, protruding toward the side face of the worm wheel 38 (see FIG. 3); a plurality of stopping parts 96 which to stopping member 59 shown in FIG. 2 stops; and a plurality of escape holes 97 which avoid the engagement of the stopping member 59. The disc protuberances 93 are formed by cutting lines in a disc and a carrying out a louvering process in which those parts are raised.

Figure 6:
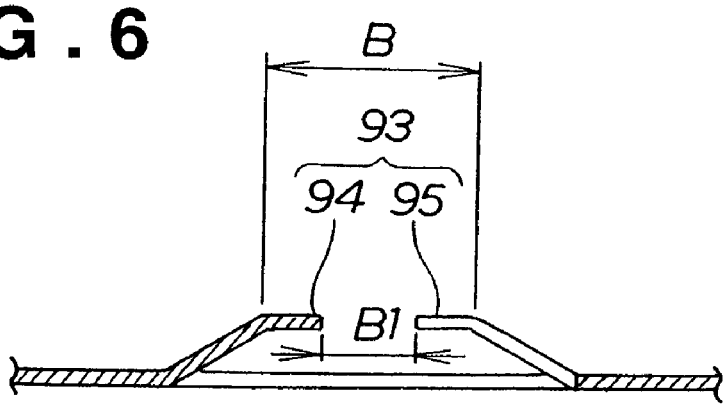
FIG. 6 is a sectional view taken along line 6—6 in FIG. 5.

As shown in FIG. 6, each of the disc protuberances 93 is made up of a first louver part 94 and a second louver part 95. The distance B1 from the tip of the first louver part 94 to the tip of the second louver part 95 is shorter than the length A of the flat part 87 shown in FIG. 4. Consequently, the disc protuberances 93 can easily pass over the flat part 87 without fitting onto the wheel protrusions 83.

The width B of the disc protuberances 93, which ride over the flat parts 87 of the wheel protrusions 83, is determined in consideration of the speed of rotation of the worm wheel 38

Figure 7:
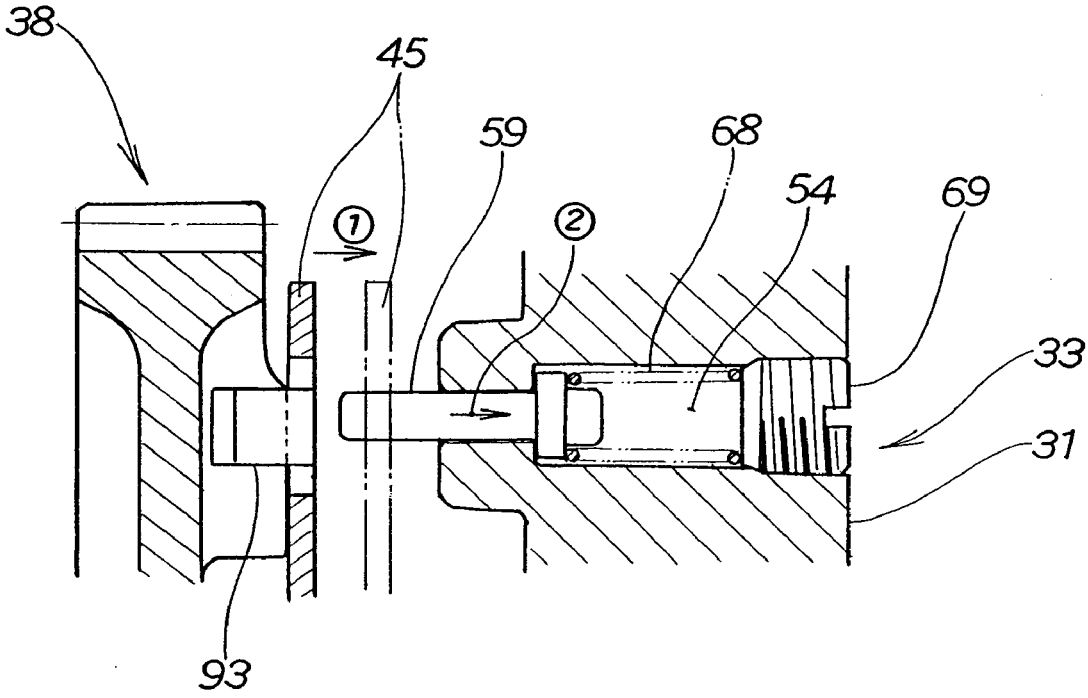
FIG. 7 is a sectional view showing a relationship between a slide washer and a stopping member.

As shown in FIG. 7, the stopping member 59 is slidably received in the receiving part 54 of the case proper 31. This stopping member 59 is urged in the direction of the slide washer 45 by the compression spring 68. This compression spring 68 is supported by the stopping member retainer 69. The stopping member 59 slides perpendicularly with respect to the side face of the worm wheel 38 along with movement of the slide washer 45.

That is, when the slide washer 45 moves as shown by arrow [1] from the position shown with solid lines to the position shown with broken lines, the stopping member 59 withdraws as shown by arrow [2]. The stopping member 59 restores the washer detector switch 53 shown in FIG. 2 to an initial state.

As will be further discussed later, when it is positioned in an escape hole 97 of the slide washer 45 (see FIG. 5), the stopping member 59 is kept in a projecting state by the compression spring 68. When the slide washer 45 rotates and the stopping member 59 hits a stopping part 96, the rotation of the slide washer 45 stops. When it is positioned on any other part of the slide washer 45, the stopping member 59 withdraws against the resistance of the compression spring 68.

Figure 8:
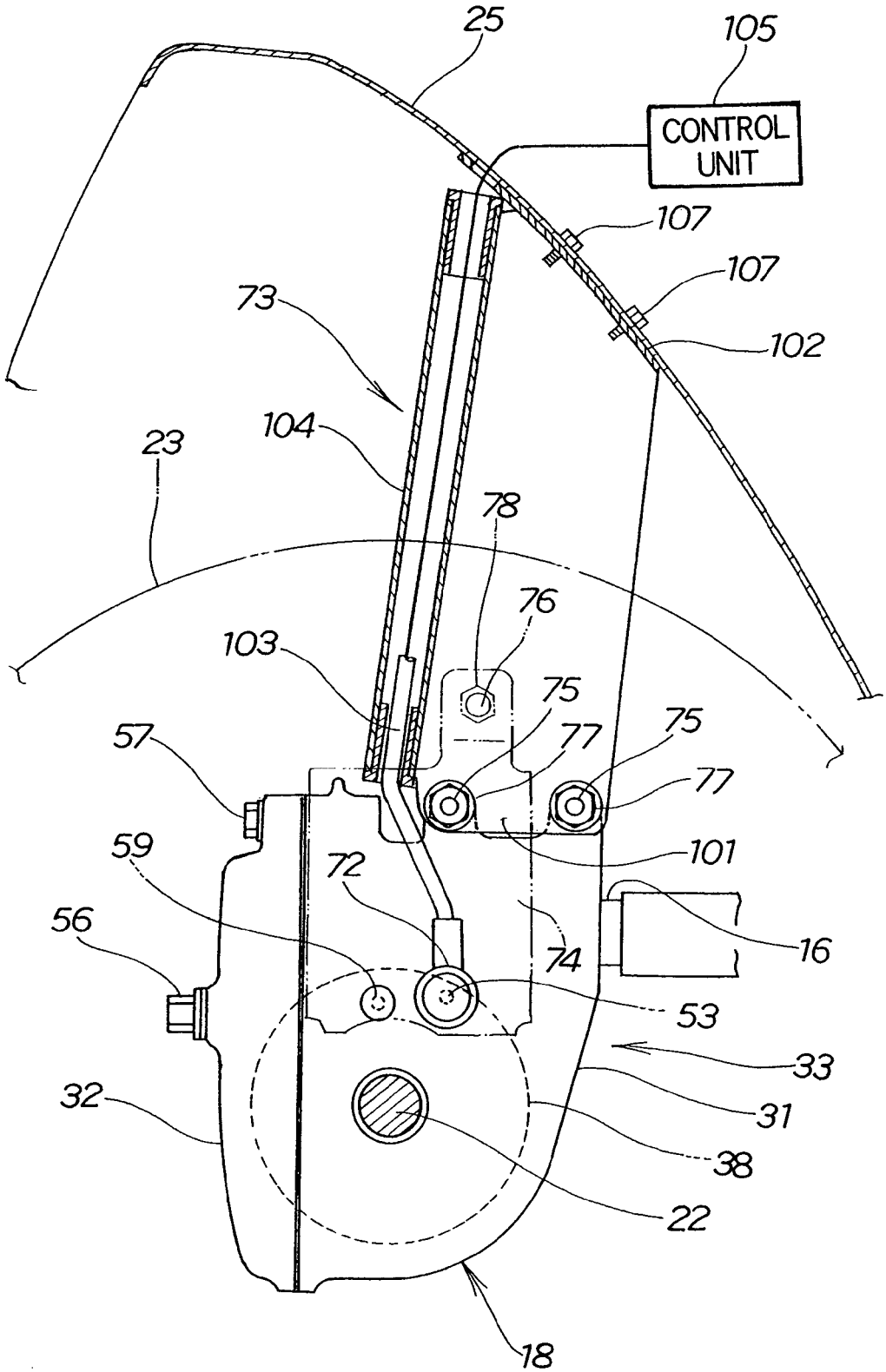
FIG. 8 is a partial section view showing the relationship between an auger transmission and an auger housing and a bracket.

FIG. 8 shows the relationship between the auger transmission 18, the auger housing 25 and the bracket 73.

A case mounting part 101 of the bracket 73 is attached to the case proper 31 of the auger transmission 18 with the bolts 75 and the nuts 77. A housing mounting part 102 of this bracket 73 is attached to the inside of the auger housing 25 with bolts 107, 107. The protective switch cover 72 is fitted over the washer detector switch 53, and the washer detector switch 53 is connected to the control unit 105 by a lead wire 103. This lead wire 103 passes through the inside of a pipe part 104 of the bracket 73. The switch bracket 74, which covers the washer detector switch 53 and the stopping member 59, is attached to the bracket 73 with a bolt 76 and a nut 78.

Figure 9:
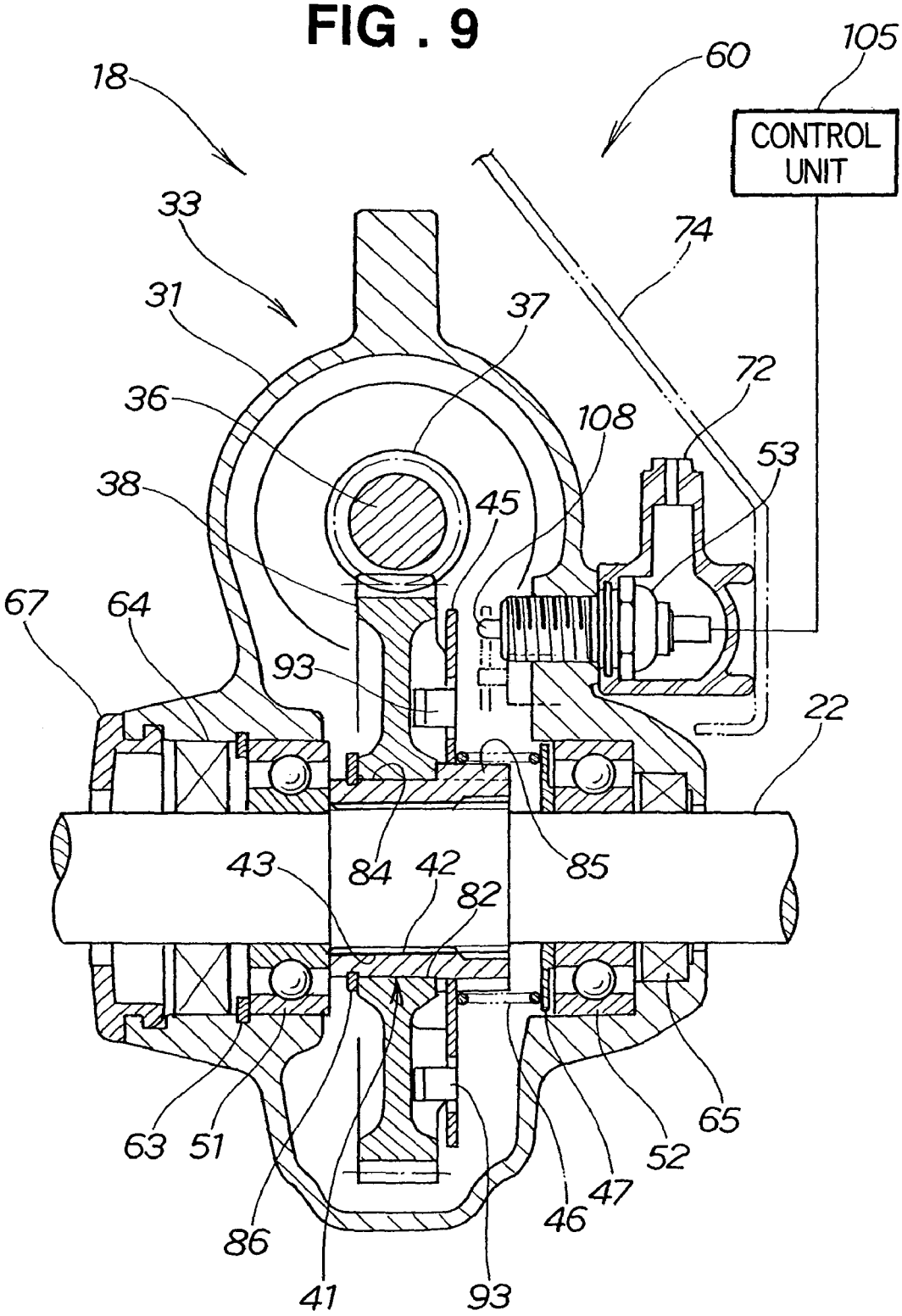
FIG. 9 is a sectional front view of an auger transmission equipped with an overload prevention device according to the invention.
Figure 10:
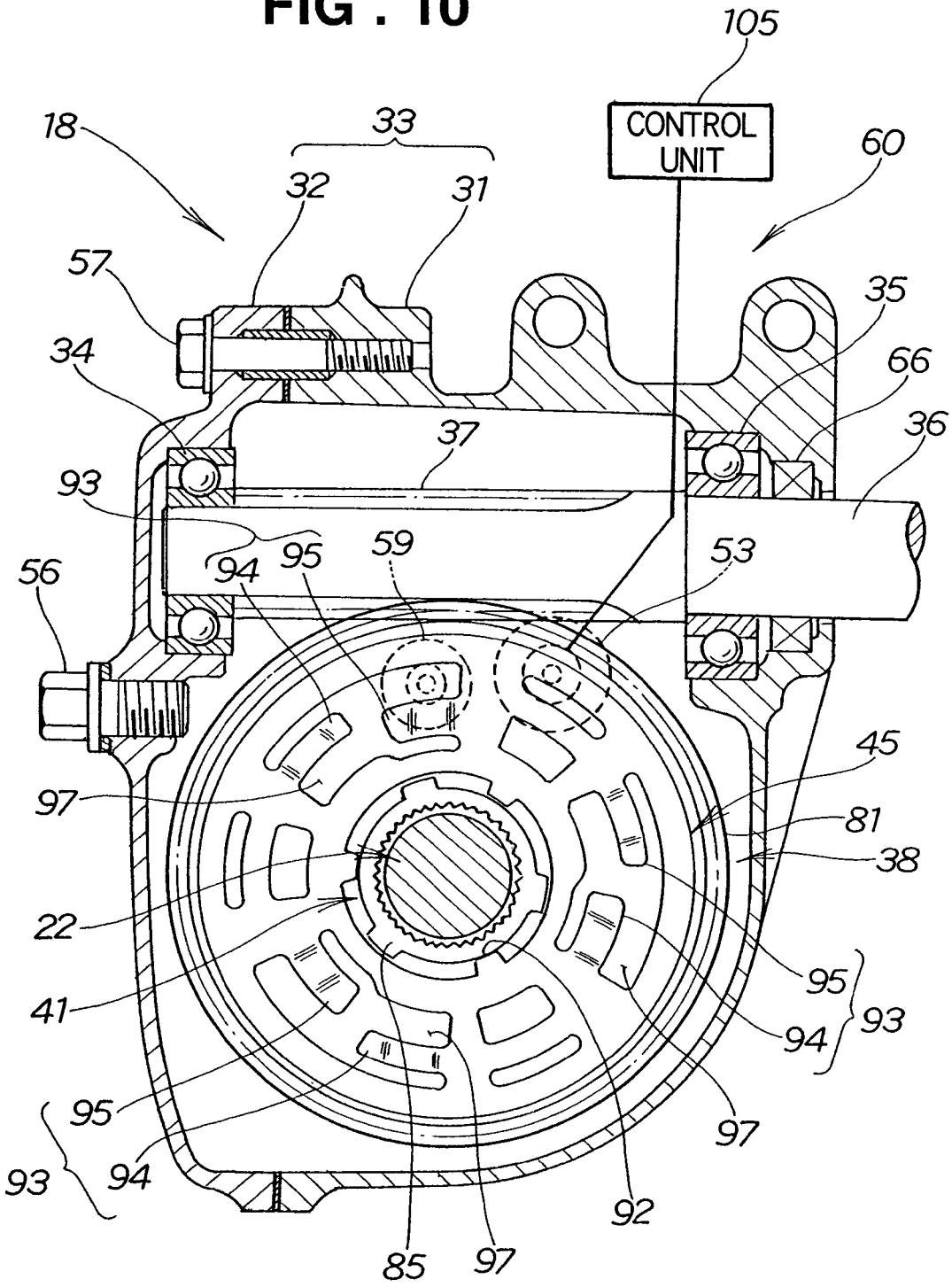
FIG. 10 is a sectional side view of an auger transmission equipped with an overload prevention device according to the invention.

FIG. 9 and FIG. 10 show the auger transmission 18 with its overload prevention device 60 in sectional view.

The worm wheel 38, as a result of the boss member 41 being press-fitted in its fitting hole 82, rotates integrally with the boss member 41 as long as it is transmitting a normal torque. However, when a torque above a predetermined level (an excessive torque) acts on the auger shaft 22, the worm wheel 38 rotates freely relative to the boss member 41, or the boss member 41 rotates freely relative to the worm wheel 38.

Preferably, a sulfurizing treatment is carried out on the face of the worm wheel 38 forming the fitting hole 82 and the circumferential face 84 of the boss member 41, of the overload prevention device 60. This sulfurizing treatment is a metal surface treatment which diffuses free sulfur into a surface layer of a ferrous material (carbon steel, cast iron, cast steel, stainless steel etc.). Because free sulfur is a rich lubricant, when rubbing of opposing contacting faces occurs due to slipping, wear is suppressed and resistance to wear increases.

Instead of sulfurizing treatment, carburizing treatment, or a combination of sulfurizing and carburizing, may alternatively be carried out on the fitting hole 82 of the worm wheel 38 and the circumferential face 84 of the boss member 41.

The washer detector switch 53 consists of a limit switch attached to the case proper 31. This switch 53 has a depressable contact 108 for detecting that the slide washer 45 has moved perpendicularly with respect to the side face of the worm wheel 38. With the state of this contact 108 being advanced (the state in which the slide washer 45 is shown with solid lines) as an OFF state and the state of this contact 108 being withdrawn (the state in which the slide washer 45 is shown with broken lines) as an ON state, it transmits ON/OFF information to the control unit 105.

The protective switch cover 72 covers the washer detector switch 53 and thereby protects the washer detector switch 53 from snow and water and so on. That is, by waterproofing the washer detector switch 53, which is a detecting part of a signal system, the life of the washer detector switch 53 is extended, and highly reliable control of the overload prevention device 60 is realized.

The switch bracket 74 covers en bloc the washer detector switch 53, the protective switch cover 72 and the lead wire 103 (see FIG. 8), and thereby protects these detecting parts of the signal system from being hit by small stones and the like.

Even if the attachment of the protective switch cover 72 to the washer detector switch 53 is imperfect, as a result of the switch bracket 74 being attached to the case proper 31 by way of the bracket 73 (see FIG. 8), it presses the protective switch cover 72 and fufils the attachment of this protective switch cover 72 so that the protective switch cover 72 is surely attached to the washer detector switch 53.

The overload prevention device 60 prevents an excessive load from acting on the power train from the engine 15 to the auger shaft 22 as power from the engine 15 is transmitted through the auger transmission 18 to the auger shaft 22 and the auger 23 in turn.

The overload prevention device 60 has: the worm wheel 38, which meshes with the worm 37 formed on the input shaft 36 (see FIG. 2) of the auger transmission 18; the boss member (cylindrical member) 41, which as a result of being fitted in the worm wheel 38 rotates integrally with it over a predetermined torque range but rotates relatively to it when a predetermined torque is exceeded, and which is integrally attached to the auger shaft 22; the slide washer 45, which is limited in angle of turn with respect to the boss member 41 and is adjacent to the worm wheel 38 and has disc protuberances 93 facing the wheel protrusions 83 (see FIG. 3) provided on the side face of the worm wheel 38; the washer detector switch 53, which detects movement of the slide washer 45 away from the side face of the worm wheel 38 when due to turning of the boss member 41 with respect to the worm wheel 38 the disc protuberances 93 mount the wheel protrusions 83; and the control unit 105, which stops the engine 15 when the number of times this detection is made by the washer detector switch 53 reaches a predetermined number of times within a predetermined period.

When a torque exceeding a predetermined value arises in the auger shaft 22, relative rotation occurs between the worm wheel 38 and the boss member 41, and the disc protuberances 93 of the slide washer 45 mount the wheel protrusions 83 of the worm wheel 38, and as a result the slide washer 45 moves away from the side face of the worm wheel 38, this movement of the slide washer 45 is detected by the washer detector switch 53, and on the basis of information from this washer detector switch 53 the engine 15 is forcibly stopped.

At this time, instantaneous overloads occurring when the auger 23 (see FIG. 1) hits a curbstone or the like and erroneous overloads caused by noise of the washer detector switch 53 and so on can be distinguished from continuous overloading caused by biting into snow or debris in the control of stopping of the engine 15.

That is, by a control unit 105 being provided which stops the engine 15 (see FIG. 1) when the number of times the washer detector switch 53 has made a detection reaches a predetermined number of times within a predetermined period, instantaneous overloads occurring when the auger 23 hits a curbstone or the like are distinguished from continuous overloading caused by biting into snow and debris. Therefore, unnecessary stopping of the engine 15 can be avoided and the efficiency of snow-removing work can be improved.

Figure 11:
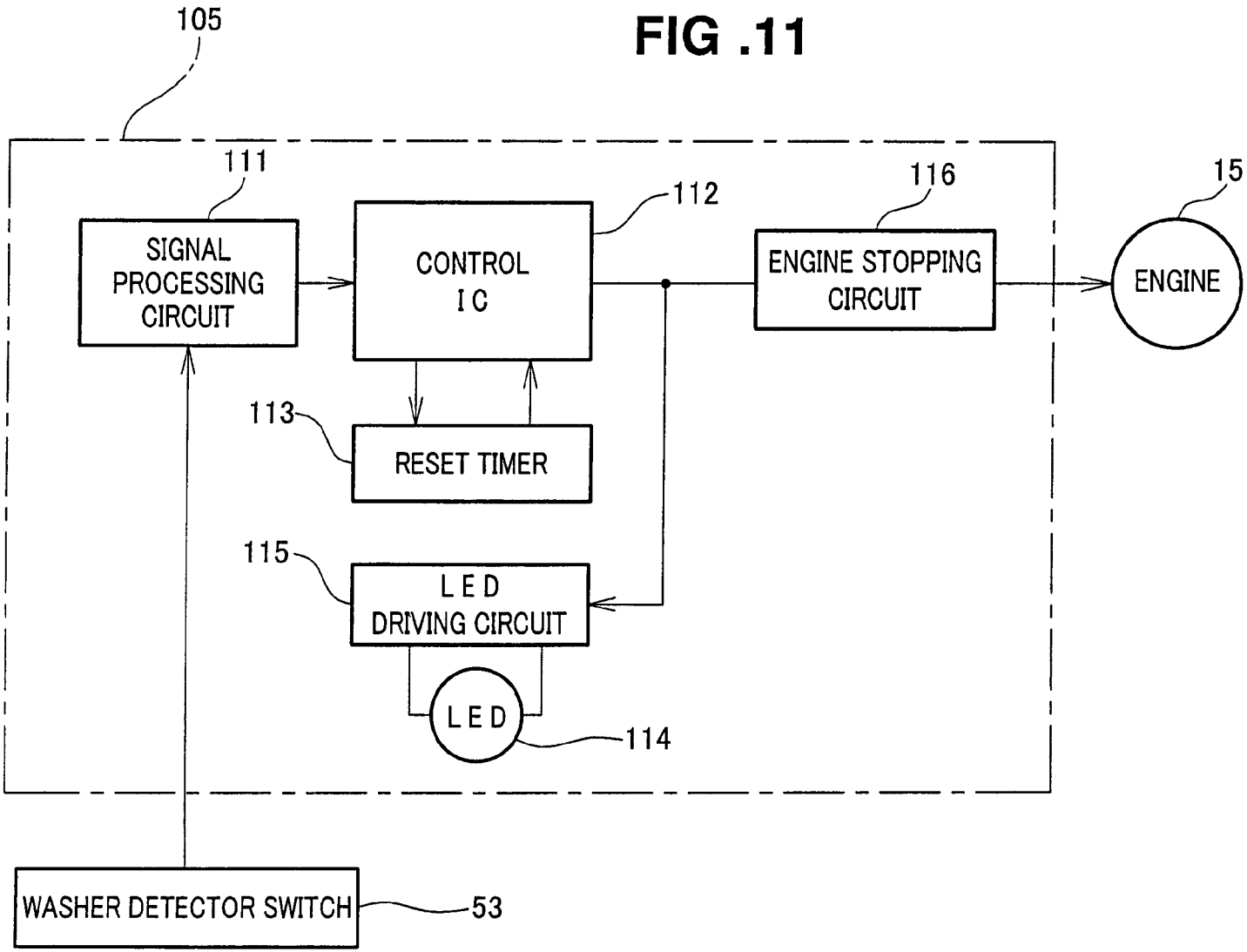
FIG. 11 is an electrical block diagram of a control unit of an overload prevention device according to the invention.

FIG. 11 is an electrical block diagram of a control unit 105 of an overload prevention device according to the invention.

The control unit 105 is made up of a signal-processing circuit 111, which receives information from the washer detector switch 53; a control IC (Integrated Circuit) 112 for controlling the engine 15 (see FIG. 1) on the basis of information from this signal-processing circuit 111; a reset timer 113, started by a command signal outputted from the control IC 112 when information is received from the washer detector switch 53; an LED (Light Emitting Diode) 114, which lights when information is received from the washer detector switch 53; an LED driving circuit 115, for lighting this LED 114; and an engine stopping circuit 116, for stopping the engine 15 on an order from the control IC 112.

Figure 12:
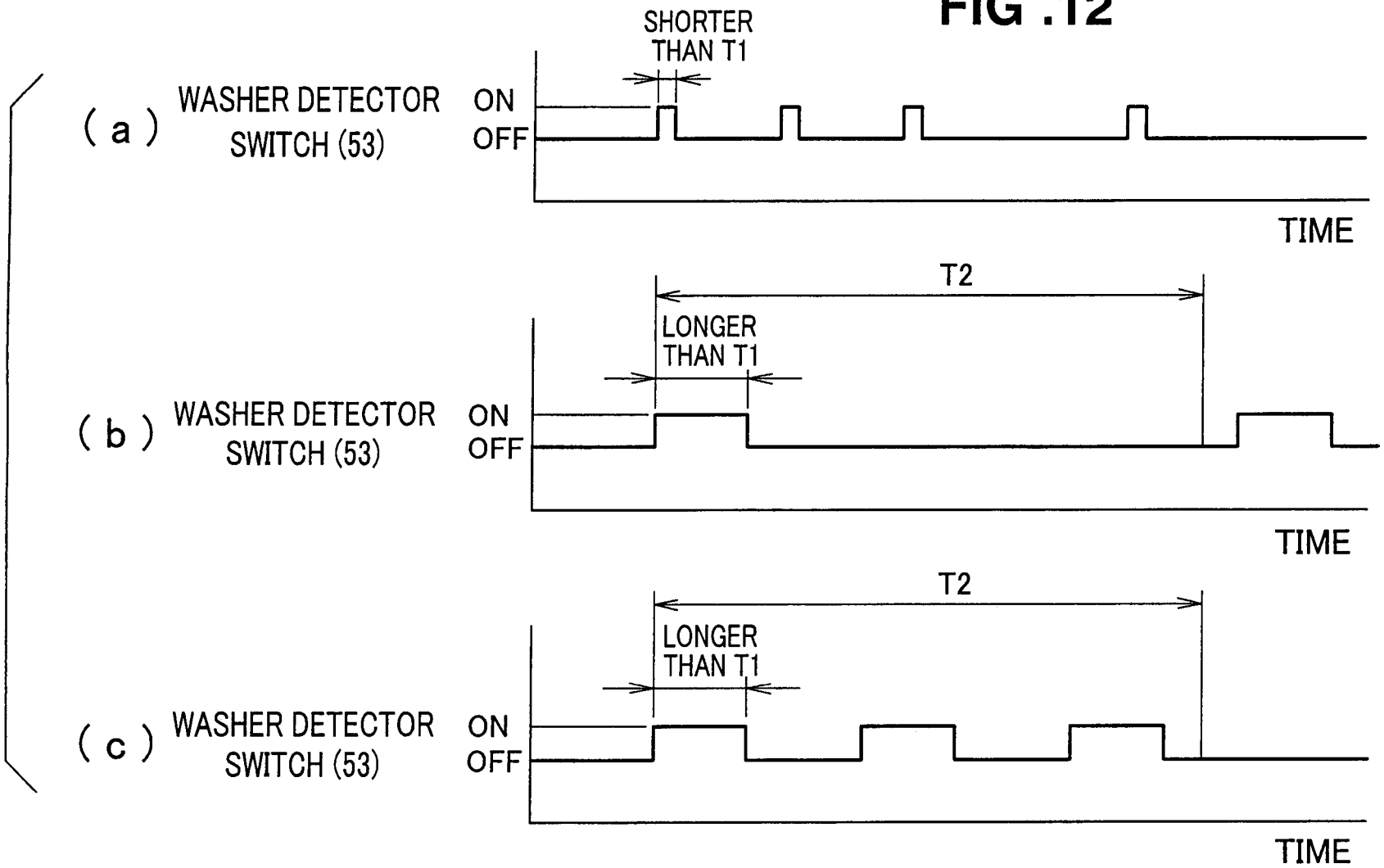
FIG. 12 is a timing chart of a signal outputted from a washer detector switch.

As shown in FIGS. 12A through 12C, the signal-processing circuit 111 performs processing to infer that a signal is being outputted from the washer detector switch 53 (hereinafter abbreviated to that the washer detector switch is ON) when the ON state of the washer detector switch 53 has persisted for more than a predetermined period T1, and to infer that it is just noise when the ON state has persisted for less than the predetermined period T1. That is, when as shown in FIG. 12A the ON state has persisted for less than the predetermined period T1, the overload prevention device is not operated.

To maintain the ON state for more than the predetermined period T1, the width B of the disc protuberances 93 which mount the flat parts 87 of length A provided on the wheel protrusions 83 are set in consideration of the speed of rotation of the worm wheel 38 shown in FIG. 3.

When ON information has been outputted from the signal-processing circuit 111 for longer than the predetermined period T1, the reset timer 113 is started by the control IC 112. And, when as shown in FIG. 12B there is only one ON information longer than the predetermined period T1 in a predetermined period T2 from the timer being started, it is inferred that it was a brief overload of the kind which arises when the auger hits a curbstone or the like, or a brief overload caused by detector noise, and it is not necessary to stop the engine 15, and the overload prevention device 60 does not operate.

When as shown in FIG. 12C there has been ON information a predetermined number of times within the predetermined period T2, the control IC 112 sends a command signal for stopping the engine 15 to the engine stopping circuit 116. That is, when there is ON information longer than the time T1 a number of times within the predetermined time T2, it is inferred that the auger 23 has bitten into snow or the like and continuous slipping is occurring, and the engine 15 is stopped.

By this means it is possible for it to be correctly determined that the auger 23 (see FIG. 1) has bitten into snow or debris. For example, the engine 15 (see FIG. 1) is not stopped on the basis of instantaneous slipping occurring at times such as when the auger 23 hits a curbstone or the like. The engine 15 being stopped on the basis of noise sent from the washer detector switch 53 (see FIG. 2) caused by vibration can be avoided.

In this preferred embodiment, as shown in FIGS. 12A through 12C, the reset timer 113 (see FIG. 11) is started the first time an ON state of the washer detector switch 53 persists for longer than a predetermined period T1, and then the engine 15 (see FIG. 1) is stopped when a predetermined number of times is counted in a predetermined period T2. That is, the ON state time and the number of counts can be set freely.

The LED driving circuit 115 shown in FIG. 11 lights the LED, on a command of the control IC 112, when a first ON information arrives from the signal-processing circuit 111, and puts out the LED, on a command signal from the control IC 112, when the engine 15 has stopped.

Figure 13:
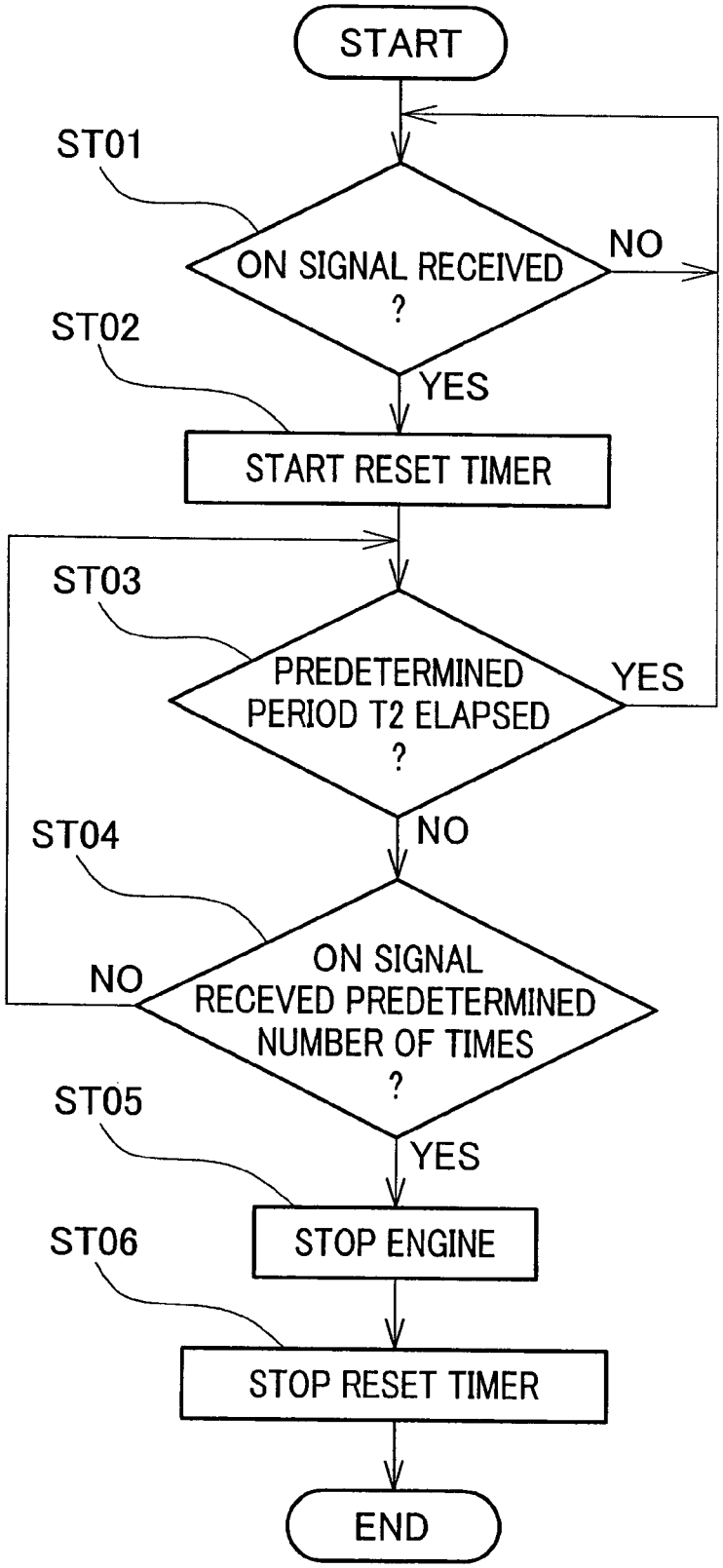
FIG. 13 is a flow chart of the control unit shown in FIG. 11.

Next, the operation of the control unit 105 shown in FIG. 11 will be described, on the basis of the flow chart shown in FIG. 13.

ST01: It is monitored whether or not there has been a predetermined ON signal (an ON state longer than the period T1) from the washer detector switch 53. If YES, processing proceeds to ST02.

ST02: The reset timer 113 is started.

ST03: It is determined whether or not the predetermined period T2 has elapsed. If YES, it is inferred to have been a momentary slip, and processing returns to ST01. If NO, processing proceeds to ST04.

ST04: It is determined whether or not the predetermined ON signal (the ON state longer than the period T1) has arisen a predetermined number of times within the predetermined period T2. That is, by ST03 and ST04 it is monitored whether or not there has been an ON signal longer than the period T1 multiple times within the predetermined period T2. When there has been this ON signal multiple times, it is inferred to be continuous slipping, and when there has been the ON signal only once, it is inferred to be an incidence of momentary slipping.

ST06: The engine 15 is stopped.

ST07: The reset timer 113 is stopped.

Figure 14:
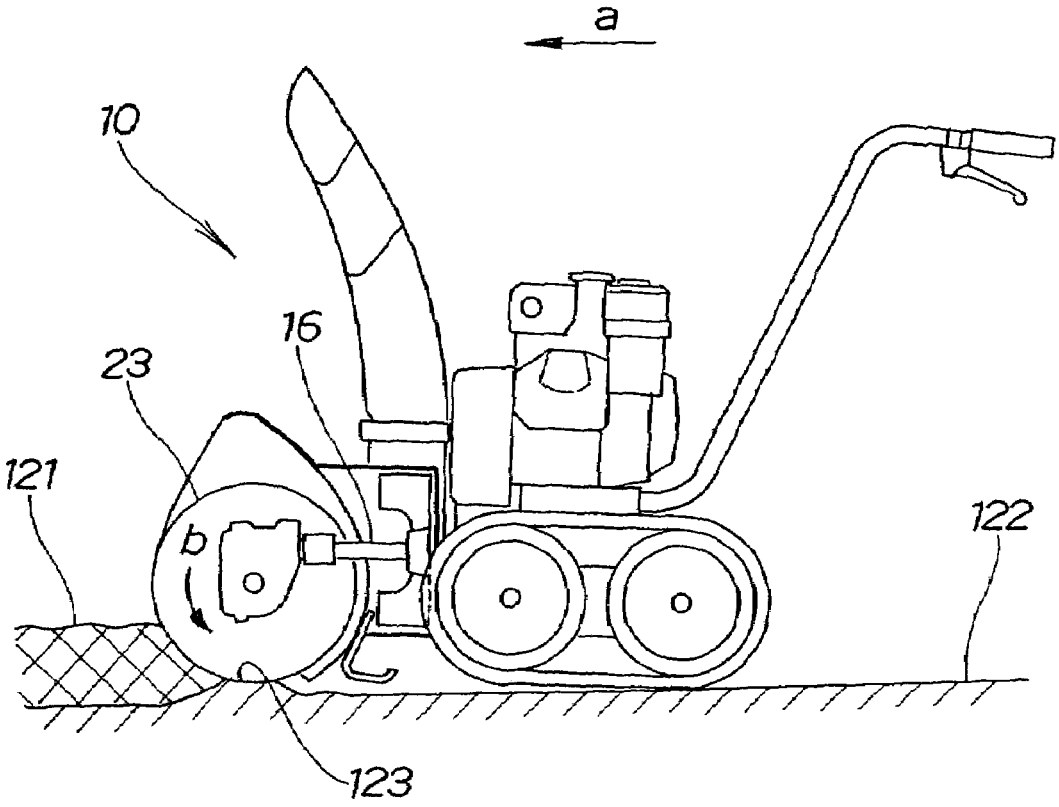
FIG. 14 is a view showing the rotation of an auger being obstructed during travel of a snow-remover.

As shown in FIG. 14, for example during snow-removal work with the snow-remover 10 traveling as shown by the arrow a, when the auger 23 of the snow-remover 10 during snow-removal bites into a lump of ice or a stone or hits a projecting part 123 of the road surface 122 as shown in this figure, the rotation of the rotating auger 23 shown by the arrow b is obstructed, and the load acting on the auger 23 itself and on the power train from the engine 15 to the auger 23 becomes excessive. In the figure, 121 is snow.

Next, the specific operation of the overload prevention device 60 when as described with reference to FIG. 14 the load acting on the auger 23 itself and on the power train from the engine 15 to the auger 23 becomes excessive will be described, on the basis of FIG. 15 through FIG. 22.

Figure 15:
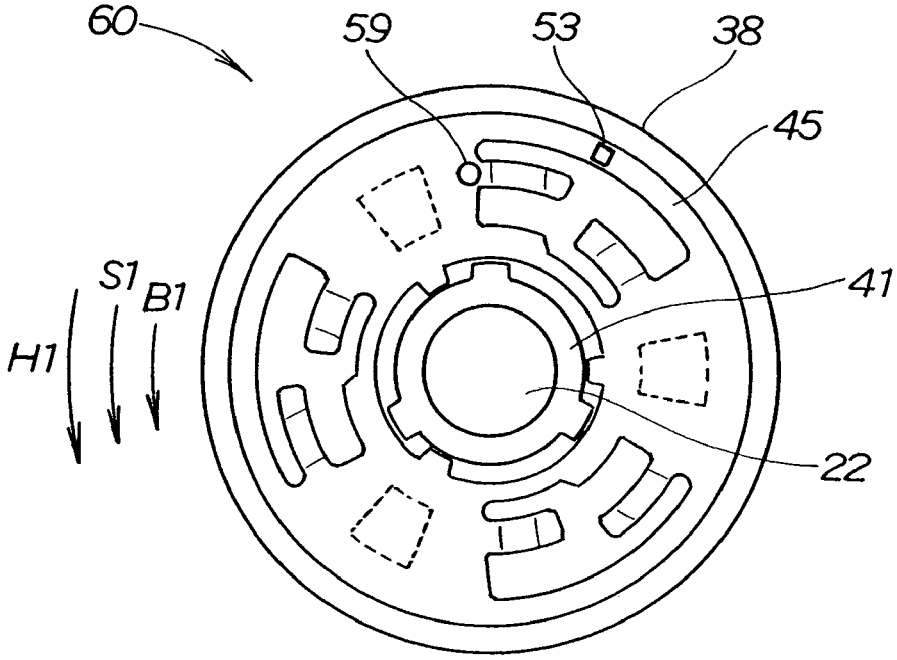
FIG. 15 through FIG. 22 are views showing operating states of a worm wheel, a boss member and a slide washer.

FIG. 15 shows the overload prevention device 60 when the auger 23 shown in FIG. 1 is in its normal rotating state. That is, the worm wheel 38 rotates as shown by the arrow H1; the slide washer 45 also rotates, in synchrony with the worm wheel 38, as shown by the arrow S1; and the auger shaft 22 and the boss member 41 also rotate in synchrony with the worm wheel 38, as shown by the arrow B1. This is the state before the overload prevention device 60 operates. The stopping member 59, shown with a white circle, is not yet in contact with the slide washer 45, and the washer detector switch 53, shown with a white square, is in its OFF state.

Figure 16:
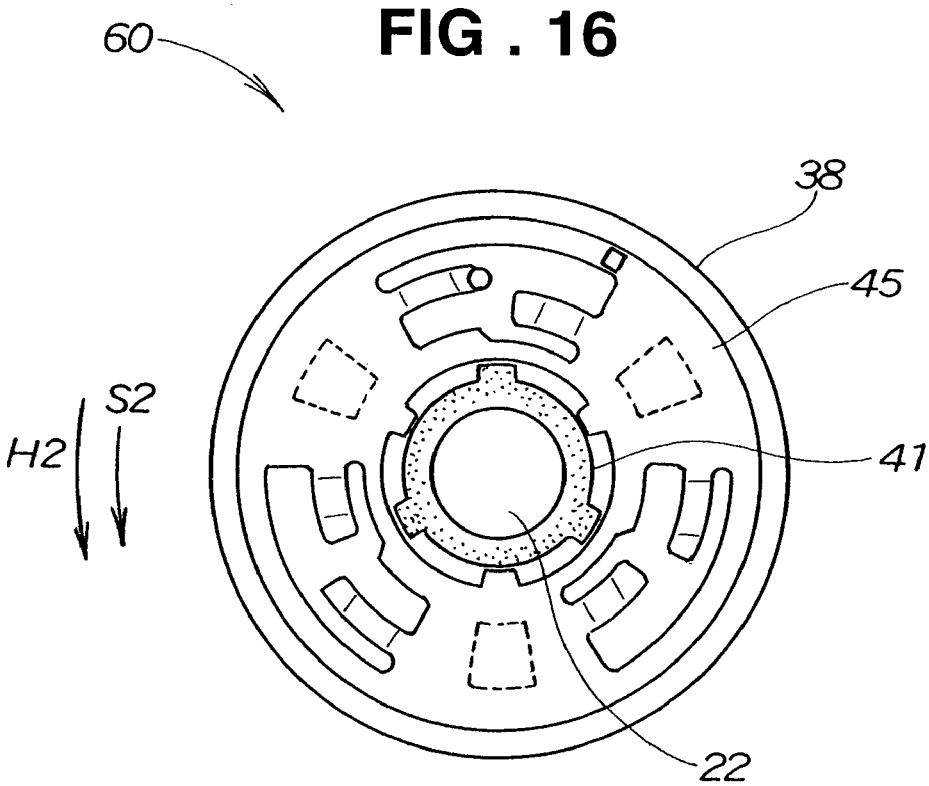

In FIG. 16, as a result of the auger 23 shown in FIG. 14 mounting snow 121 or the like, the auger shaft 22 and the boss member 41 stop rotating, and the worm wheel 38 starts to slip with respect to the boss member 41.

That is, the worm wheel 38 rotates as shown by the arrow H2, and the slide washer 45 also rotates, in synchrony with the worm wheel 38, as shown by the arrow S2. Because the engine 15 continues to rotate, the power from the engine 15 is transmitted through the drive shaft 16 (see FIG. 1) and the input shaft 36 of the auger transmission 18 (see FIG. 2) to the worm wheel 38, and consequently the worm wheel 38 starts to rotate (slip) relative to the boss member 41, which is in a locked state.

Figure 17:
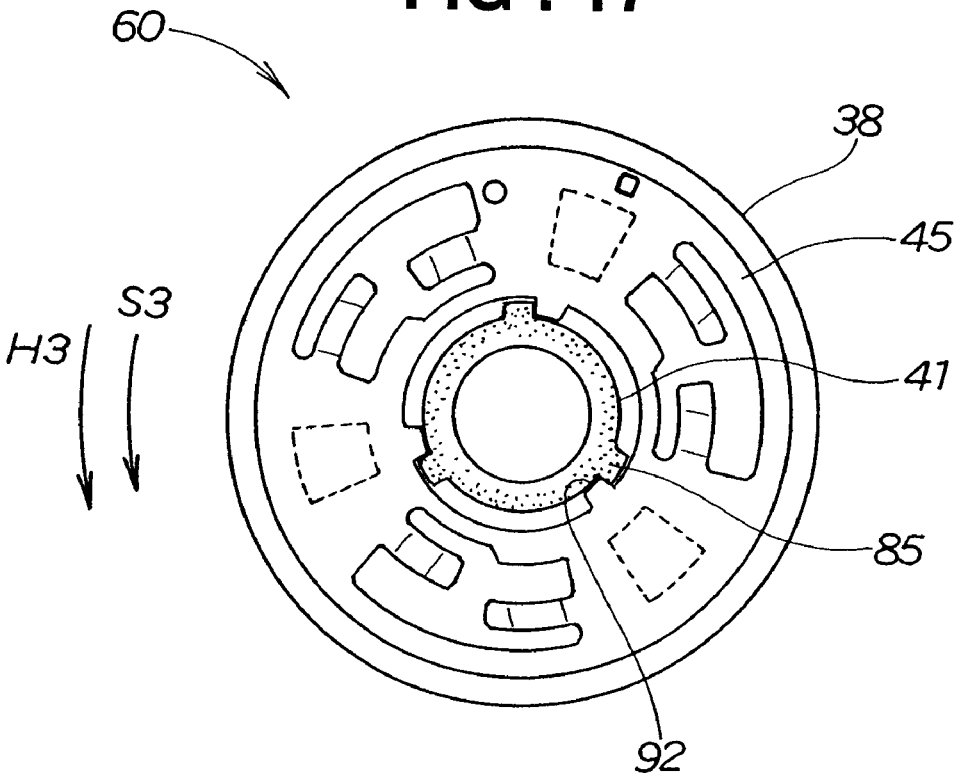

As shown in FIG. 17, the worm wheel 38 rotates as shown by the arrow H3, and the slide washer 45 also rotates in synchrony with the worm wheel 38 as shown by the arrow S3, as a result of which the internal projections 92 of the slide washer 45 hit the external projections 85 of the boss member 41 and the slide washer 45 stops.

Figure 18:
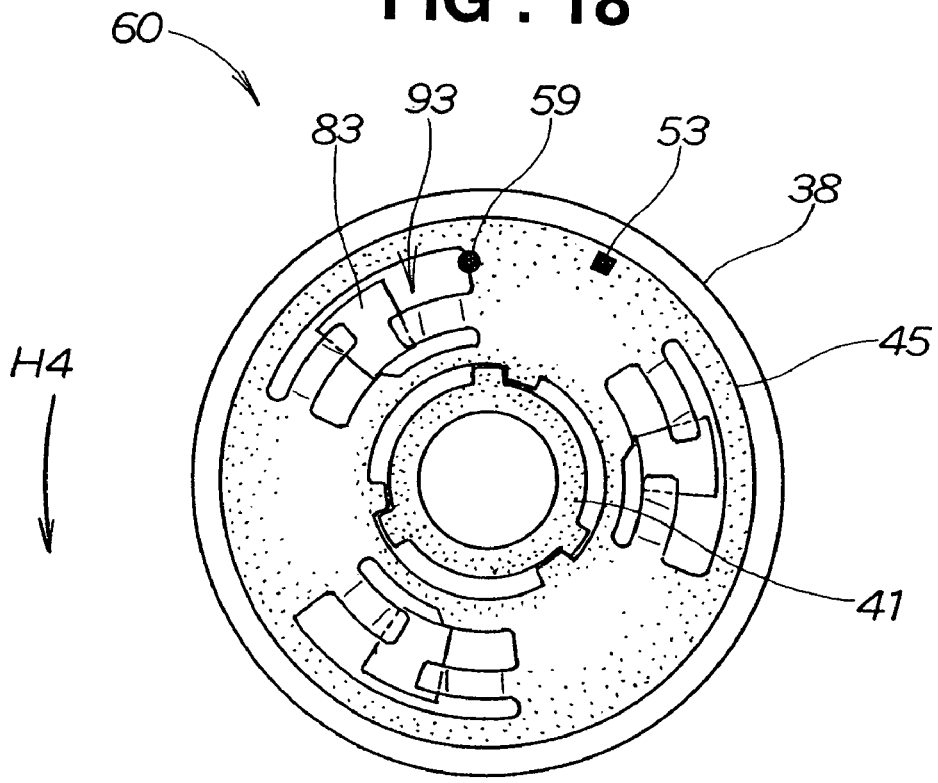

As shown in FIG. 18, by the worm wheel 38 rotating as shown by the arrow H4, the wheel protrusions 83 of the worm wheel 38 mount or engage the disc protuberances 93 of the slide washer 45. Consequently, the slide washer 45 moves in the obverse direction of the figure and pushes the stopping member 59 and brings the washer detector switch 53 to the ON state.

FIG. 18 shows the slide washer 45 in a stopped state and the stopping member 59, shown as a black circle, in a withdrawn state, and shows the washer detector switch 53, shown as a black square, in its ON state.

Figure 19:
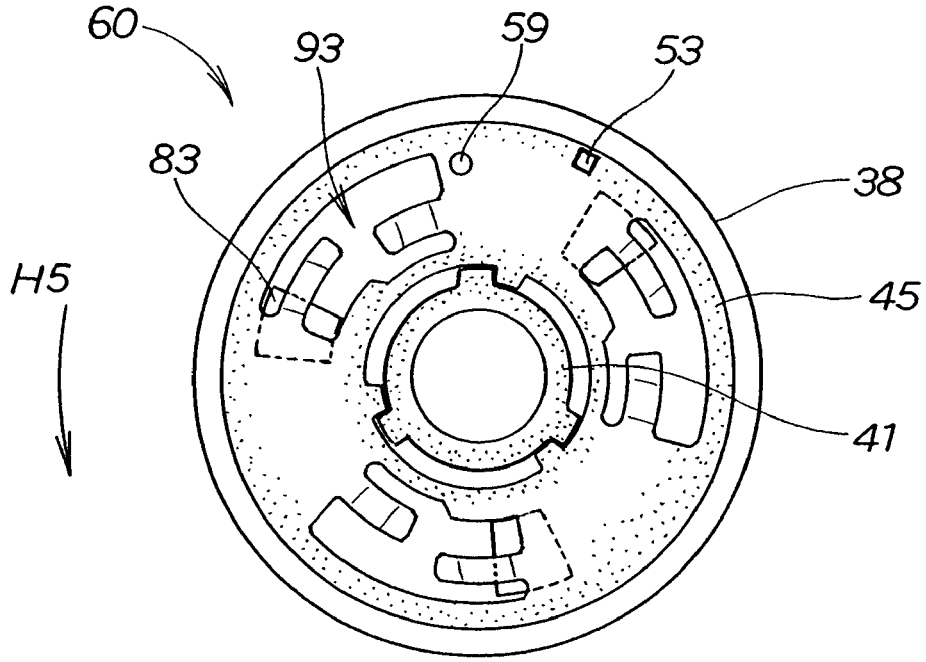

In FIG. 19, as a result of the worm wheel 38 rotating as shown by the arrow H5, the wheel protrusions 83 of the worm wheel 38 mount the disc protuberances 93 of the slide washer 45. When within a predetermined period from the first mounting this mounting is repeated, the engine 15 (see FIG. 1) is stopped. During this time, the slide washer 45 moves in the obverse direction of the figure and the moves in the reverse direction of the figure the same number of times as the number of mountings.

Because the wheel protrusions 83 of the worm wheel 38 are not atop the disc protuberances 93 of the slide washer 45, FIG. 19 shows the stopping member 59, shown as a white circle, not yet in contact with the slide washer 45, and shows the washer detector switch 53, shown as a white square, in its OFF state.

Figure 20:
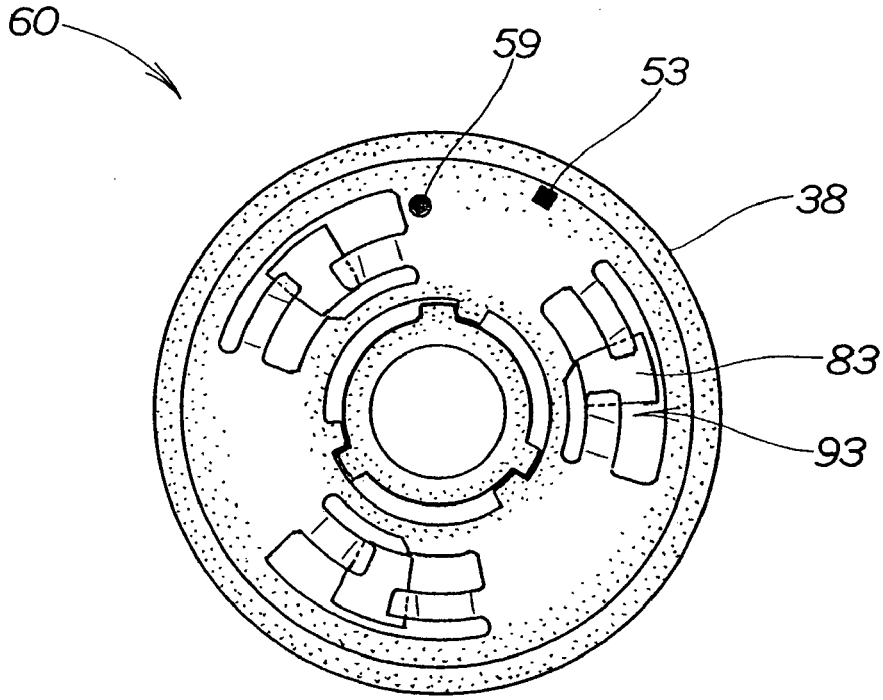

That is, in FIG. 20, the worm wheel 38 is stopped. The worm wheel 38 is shown stopped, the stopping member 59, shown with a black circle, is in its withdrawn state, and the washer detector switch 53, shown with a black square, is in its ON state.

Figure 21:
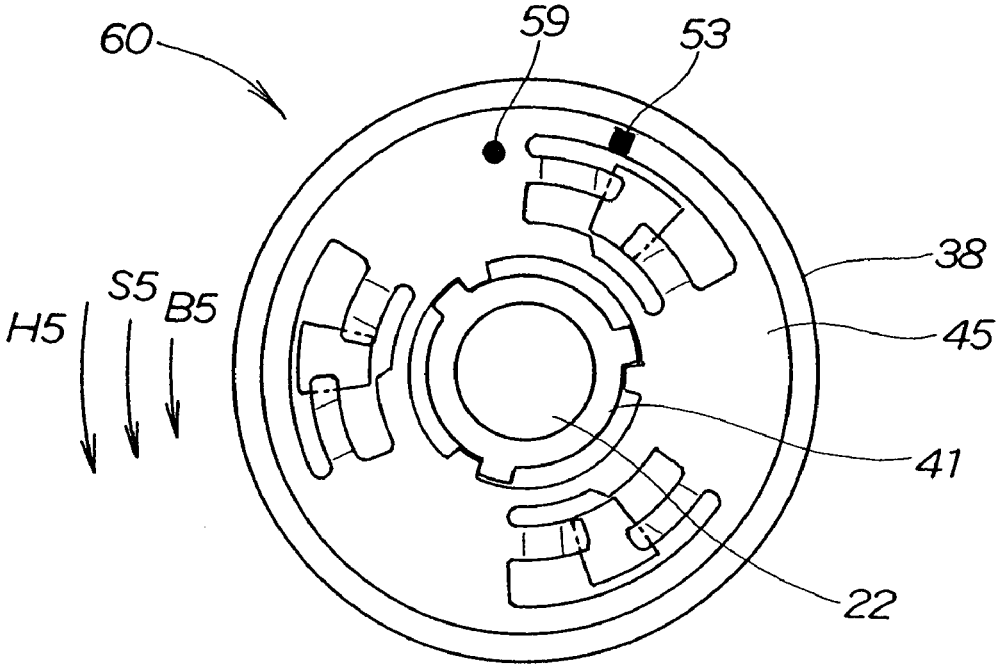

In FIG. 21, after the snow or other obstruction on the auger 23 is removed, by the engine 15 being restarted (see FIG. 1), the worm wheel 38 is rotated as shown by the arrow H5, and the slide washer 45 also rotates, in synchrony with the worm wheel 38, as shown by the arrow S5, and the boss member 41 also rotates, in synchrony with the worm wheel 38, as shown by the arrow B5.

Figure 22:
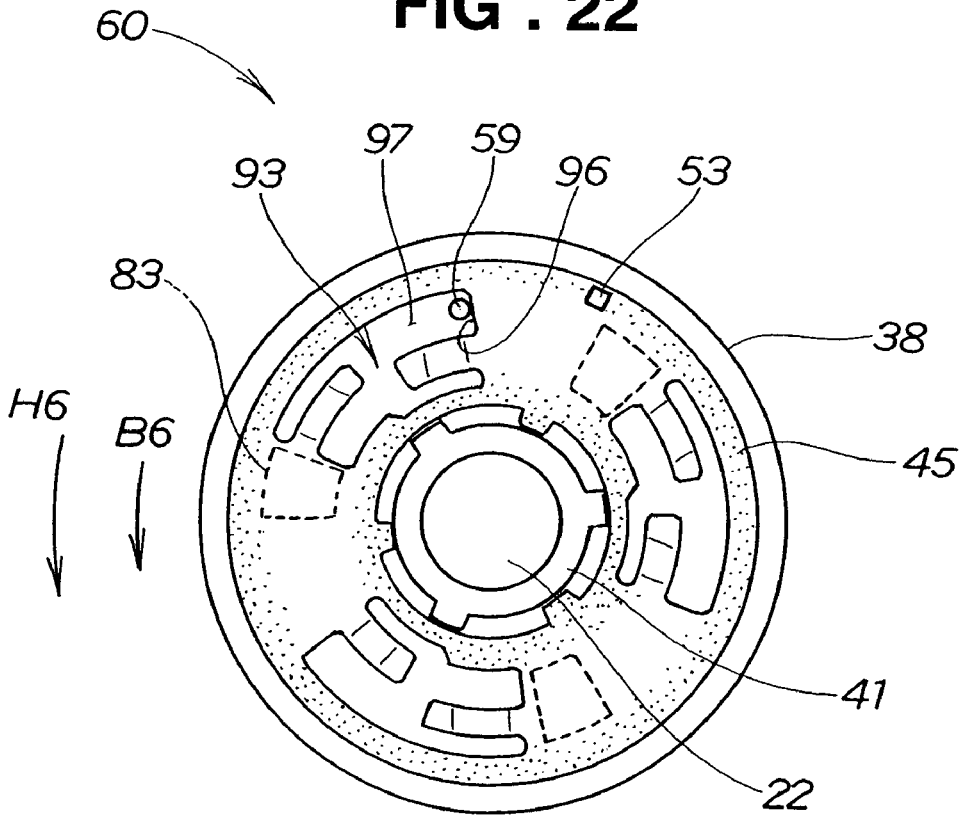

In FIG. 22, as a result of the worm wheel 38, the slide washer 45 and the boss member 41 rotating in synchrony, the stopping member 59 fits in an escape hole 97 of the slide washer 45. Then, the stopping member 59 engages with a stopping part 96 of the slide washer 45 and stops the slide washer 45. The worm wheel 38 rotates as shown by the arrow H6. The boss member 41 continues to rotate in synchrony with the worm wheel 38 as shown by the arrow B6.

As a result of the worm wheel 38 and the boss member 41 rotating, the wheel protrusions 83 of the worm wheel 38 come off or disengage the disc protuberances 93 of the slide washer 45, and the slide washer 45 returns in the reverse direction of the figure under the elastic reaction of the elastic member 46 (see FIG. 2) and returns to the initial state shown in FIG. 15.

Obviously, various minor changes and modifications of the present invention are possible in the light of the above teaching. It is therefore to be understood that without departing from the scope of the appended claims the invention may be practiced otherwise than as specifically described.

What is claimed is:

1. An overload prevention device for an auger transmission of a snow removing machine for preventing an excessive load from acting on a power train of the auger transmission from an engine to an auger and an auger shaft of the snow removing machine, the overload prevention device comprising:

a worm wheel meshing with a worm formed on an input shaft of the auger transmission, the worm wheel having a plurality of wheel protrusions formed at a side surface thereof;

a cylindrical member integrally connected to the auger shaft and engaging with the worm wheel for rotation therewith over a predetermined torque range and for rotation relative thereto when a predetermined torque is exceeded;

a generally disk-shaped member disposed adjacent to the worm wheel for restricting a rotating angle of the cylindrical member, the disk-shaped member having a plurality of generally disk-shaped protuberances facing the wheel protrusions of the worm wheel;

a detector for outputting a detection signal each time the detector detects movement of the disk-shaped member away from the side surface of the worm wheel when the protuberances of the disk-shaped member ride on the wheel protrusions of the worm wheel responsive to rotation of the cylindrical member and the worm wheel relative to one another, the detector having an ON state corresponding to a state during which the detector outputs the detection signal and an OFF state corresponding to a state during which the detector does not output the detection signal;

a control unit for stopping operation of the engine when the detector outputs the detection signal a preselected number of times within a preselected time period; and a stopper member for temporarily stopping movement of the disk-shaped member to restore the detector to the OFF state from the ON state.

2. An overload prevention device for an auger transmission of a snow removing machine for preventing an excessive load from acting on a power train of the auger transmission from an engine to an auger and an auger shaft of the snow removing machine, the overload prevention device comprising:

a worm wheel meshing with a worm formed on an input shaft of the auger transmission, the worm wheel having a plurality of wheel protrusions formed at a side surface thereof, each of the wheel protrusions having a top portion having a planar surface extending in a direction generally perpendicular to an axis of rotation of the worm wheel;

a cylindrical member integrally connected to the auger shaft and engaging with the worm wheel for rotation therewith over a predetermined torque range and for rotation relative thereto when a predetermined torque is exceeded;

a generally disk-shaped member disposed adjacent to the worm wheel for restricting a rotating angle of the cylindrical member, the disk-shaped member having a plurality of generally disk-shaped protuberances facing the wheel protrusions of the worm wheel;

a detector for outputting a detection signal each time the detector detects movement of the disk-shaped member away from the side surface of the worm wheel when the protuberances of the disk-shaped member ride on the wheel protrusions of the worm wheel responsive to rotation of the cylindrical member and the worm wheel relative to one another; and a control unit for stopping operation of the engine when the detector outputs the detection signal a preselected number of times within a preselected time period.

3. An overload prevention device according to claim 2; wherein each of the protuberances of the disk-shaped member comprises a first louver-shaped portion and a second louver-shaped portion; and wherein a distance between confronting tip portions of the first and second louver-shaped portions is shorter than a length of the planar surface of the top portion of the wheel protrusion.

4. A combination according to claim 1; further comprising a biasing member for biasing the stopper member in the direction of the movable member.

5. A combination according to claim 1; wherein the stopper member is mounted for undergoing sliding movement in a direction generally perpendicular to the surface of the first rotational member at which the protrusions are formed.

6. A combination according to claim 1; wherein the stopper member is slidably received in a transmission case of the auger transmission.

7. An overload prevention device according to claim 1; further comprising a biasing member for biasing the stopper member in the direction of the disk-shaped member.

8. An overload prevention device according to claim 1; wherein the stopper member is mounted for undergoing sliding movement in a direction generally perpendicular to the side surface of the worm wheel.

9. An overload prevention device according to claim 1; wherein the stopper member is slidably received in a transmission case of the auger transmission.

10. An overload prevention device for an auger transmission of a snow removing machine for preventing an excessive load from acting on a power train of the auger transmission from an engine to an auger and an auger shaft of the snow removing machine, the overload prevention device comprising:

a worm wheel meshing with a worm formed on an input shaft of the auger transmission, the worm wheel having a plurality of wheel protrusions formed at a side surface thereof;

a cylindrical member integrally connected to the auger shaft and engaging with the worm wheel for rotation therewith over a predetermined torque range and for rotation relative thereto when a predetermined torque is exceeded;

a generally disk-shaped member disposed adjacent to the worm wheel for restricting a rotating angle of the cylindrical member, the disk-shaped member having a plurality of generally disk-shaped protuberances facing the wheel protrusions of the worm wheel;

a detector for outputting a detection signal each time the detector detects movement of the disk-shaped member away from the side surface of the worm wheel when the protuberances of the disk-shaped member ride on the wheel protrusions of the worm wheel responsive to rotation of the cylindrical member and the worm wheel relative to one another; and a control unit for stopping operation of the engine when the detector outputs the detection signal a preselected number of times within a preselected time period;

wherein the control unit comprises a signal processing circuit for receiving and processing the detection signal from the detector, a control integrated circuit for controlling operation of the engine in accordance with a signal from the signal processing circuit, a reset timer initiated by a command signal from the control integrated circuit when the signal processing circuit receives the detection signal from the detector, and an engine stopping circuit for stopping operation of the engine in accordance with a control signal from the control integrated circuit when the detection signal of the detector is outputted a preselected number of times within the preselected time period.

11. In combination with a snow removing machine having an engine, an auger, and an auger transmission for transmitting power from the engine to the auger, an overload prevention device for preventing an excessive load on the auger transmission, the overload prevention device comprising:

a first rotational member connected to be rotationally driven by an input shaft of the auger transmission, the first rotational member having a plurality of protrusions formed at a surface thereof;

a second rotational member engaging the first rotational member for rotation therewith over a predetermined torque range and for rotation relative thereto when a predetermined torque is exceeded;

a movable member mounted adjacent to the first rotational member for undergoing movement to restrict a rotating angle of the second rotational member, the movable member having a plurality of protuberances for engagement with the protrusions of the first rotational member;

a detector for outputting a detection signal each time the detector detects movement of the movable member in a direction away from the first rotational member when the protuberances of the movable member engage the protrusions of the first rotational member responsive to rotation of the second rotational member and the first rotational member relative to one another, the detector having an ON state corresponding to a state during which the detector outputs the detection signal and an OFF state corresponding to a state during which the detector does not output the detection signal;

a control unit for stopping operation of the engine when the detector outputs the detection signal a preselected number of times within a preselected time period; and a stopper member for temporarily stopping movement of the third rotational member to restore the detector to the OFF state from the ON state.

12. In combination with a snow removing machine having an engine, an auger, and an auger transmission for transmitting power from the engine to the auger, an overload prevention device for preventing an excessive load on the auger transmission, the overload prevention device comprising:

a first rotational member connected to be rotationally driven by an input shaft of the auger transmission, the first rotational member having a plurality of protrusions formed at a surface thereof, each of the protrusions having a portion having a planar surface extending in a direction generally perpendicular to an axis of rotation of the first rotational member;

a second rotational member engaging the first rotational member for rotation therewith over a predetermined torque range and for rotation relative thereto when a predetermined torque is exceeded;

a movable member mounted adjacent to the first rotational member for undergoing movement to restrict a rotating angle of the second rotational member, the movable member having a plurality of protuberances for engagement with the protrusions of the first rotational member;

a detector for outputting a detection signal each time the detector detects movement of the movable member in a direction away from the first rotational member when the protuberances of the movable member engage the protrusions of the first rotational member responsive to rotation of the second rotational member and the first rotational member relative to one another; and a control unit for stopping operation of the engine when the detector outputs the detection signal a preselected number of times within a preselected time period.

13. A combination according to claim 12; wherein each of the protuberances of the movable member comprises a first louver-shaped portion and a second louver-shaped portion; and wherein a distance between confronting tip portions of the first and second louver-shaped portions is shorter than a length of the planar surface of the top portion of the first rotational member.

14. In combination with a snow removing machine having an engine, an auger, and an auger transmission for transmitting power from the engine to the auger, an overload prevention device for preventing an excessive load on the auger transmission, the overload prevention device comprising:

a first rotational member connected to be rotationally driven by an input shaft of the auger transmission, the first rotational member having a plurality of protrusions formed at a surface thereof;

a second rotational member engaging the first rotational member for rotation therewith over a predetermined torque range and for rotation relative thereto when a predetermined torque is exceeded;

a movable member mounted adjacent to the first rotational member for undergoing movement to restrict a rotating angle of the second rotational member, the movable member having a plurality of protuberances for engagement with the protrusions of the first rotational member;

a detector for outputting a detection signal each time the detector detects movement of the movable member in a direction away from the first rotational member when the protuberances of the movable member engage the protrusions of the first rotational member responsive to rotation of the second rotational member and the first rotational member relative to one another; and a control unit for stopping operation of the engine when the detector outputs the detection signal a preselected number of times within a preselected time period;

wherein the control unit comprises a signal processing circuit for receiving and processing the detection signal from the detector, a control integrated circuit for controlling operation of the engine in accordance with a signal from the signal processing circuit, a reset timer initiated by a command signal from the control integrated circuit when the signal processing circuit receives the detection signal from the detector, and an engine stopping circuit for stopping operation of the engine in accordance with a control signal from the control integrated circuit when the detection signal of the detector is outputted a preselected number of times within the preselected time period.

* * * * *